United States Patent [19]

Pelabon

[11] 4,354,612

[45] Oct. 19, 1982

[54] SYSTEM FOR ATTACHMENT OF A TANK WITHIN A CONTAINER FRAME

[75] Inventor: Jean Pelabon, Neuilly, France

[73] Assignee: A.N.F. Industrie, Crespin, France

[21] Appl. No.: 172,694

[22] Filed: Jul. 28, 1980

[30] Foreign Application Priority Data

Aug. 7, 1979 [FR] France ..... 79 20153

[51] Int. Cl.[3] ..... B65D 88/22; B65D 90/20

[52] U.S. Cl. ..... 220/401; 206/591; 220/1.5; 220/439

[58] Field of Search ..... 220/1.5, 437, 439, 435, 220/71, 83, 448, 401; 206/591, 583; 248/146

[56] References Cited

U.S. PATENT DOCUMENTS 2,729,327 1/1956 Roy ..... 206/583 X
2,928,536 3/1960 Weaver, Jr. et al. ..... 206/591 X
3,251,501 5/1966 Mesnaser ..... 220/437
4,065,022 12/1977 Cainand ..... 220/71
4,098,426 7/1978 Gerhard ..... 22/401

FOREIGN PATENT DOCUMENTS 1314261 4/1973 United Kingdom ..... 220/439

*Primary Examiner*—Allan N. Shoap
*Attorney, Agent, or Firm*—Holman & Stern

[57] ABSTRACT

A cylindrical tank for land, sea or air transport is attached within a container frame by means of a system comprising cradles and upright members, a pair of first coupling devices between each cradle and a corresponding annular strengthening rib of the tank for securing the tank in the longitudinal direction and allowing one degree of freedom in the transverse and vertical directions. A pair of second coupling devices between the tank and the upright members limits and damps the displacements in the vertical and transverse directions.

3 Claims, 4 Drawing Figures

SYSTEM FOR ATTACHMENT OF A TANK WITHIN A CONTAINER FRAME

BACKGROUND OF THE INVENTION

This invention relates to a system for attachment of a cylindrical tank within a container frame such as those employed for land, sea or air transport.

Tank containers usually consist of a cylindrical tank placed within a parallelepipedal frame or the like which carries standard handling and stacking elements.

During transport or handling operations, containers of this type are subjected to multiple stresses.

The stresses are directed in the longitudinal as well as the vertical and transverse directions of the tank. The longitudinal stresses are produced especially by impacts at the time of abrupt collision or deceleration, for example during a sudden brake application or a collision. Transverse and vertical movements are essentially caused by vibrations imparted by the transport vehicle on which the container is mounted.

A container which is capable of absorbing some of the above-mentioned stresses is already known. By way of example, a container of this type is described in U.S. Pat. No. 4,065,022 to Cainaud. However, this container fails to solve all problems relating to safety and good behavior in the course of a journey effected by the supporting vehicle. In fact, the coupling means between the cradle and the annular strengthening rib and between the upright members of the frame and the clamping collars make it possible only to absorb vertical stresses while permitting partial absorption of transverse stresses on condition that these latter are directed from the tank to the supporting vehicle. On the other hand, if for any reason the position of the tank is reversed on the supporting vehicle, the coupling means in that case no longer offer the same resistance and the tank is consequently protected to a lesser extent. It should further be noted that, at the end of a certain period of use, the coupling means are liable to stretch, in which case the tank can no longer be correctly maintained on its frame.

BRIEF SUMMARY OF THE INVENTION

The aim of this invention is to overcome the above-mentioned disadvantages and to mount the tank within its frame in order to obtain a semi-rigid assembly which affords resistance to the different stresses while permitting free elastic deformations of one of the elements (frame or tank) with respect to the other and therefore makes it possible to protect the tank.

The present invention is directed to a system for attachment of a cylindrical tank within a container frame, said frame being constituted by at least two semi-circular cradles for receiving said tank and by two upright members rigidly fixed to each cradle and in diametrically opposite relation. At least one annular strengthening rib is provided on said tank and located in the vicinity of each cradle. Provision is also made between each upright member and the tank for coupling means comprising an elastic member interposed between an element which is rigidly fixed to the tank and an element which is rigidly fixed to the frame so as to limit the displacements of said tank. In addition, said system essentially comprises one pair of coupling devices between each cradle and the corresponding annular strengthening rib. Said first coupling devices have the design function of securing said tank in the longitudinal direction and of allowing one degree of freedom of movement of said tank in the transverse direction and in the vertical direction.

By virtue of the present invention, resistance to impacts or longitudinal forces is enhanced by a rigid attachment system which nevertheless permits one degree of freedom of amplitude limited to transverse and vertical stresses.

In the system of attachment in accordance with the invention, the first coupling devices ensure good resistance to longitudinal impacts while permitting partial transverse or vertical expansions or deformations within the limits permitted by the connection between tank and cradles whilst the second coupling devices limit the vertical and transverse deformations to those permitted by the first coupling devices and then ensure that the tank is rigidly maintained in position while preventing any excessive rotational displacement.

In accordance with one embodiment of the invention, each first coupling device comprises an arm rigidly fixed to the annular strengthening rib and oriented radially, a threaded tube oriented longitudinally within the cradle and located opposite to an elongated slot of said arm, a packing-piece between said arm and a corresponding radial wall of said cradle, a bearing plate placed between one wall of said arm which is opposite to said packing-piece and a head of a screw which is adapted to cooperate with said threaded tube. The relative dimensions of said arm and the cross-section of said screw are such as to provide the tank with one degree of freedom in the transverse direction and in the vertical direction.

In another embodiment of the invention, each second coupling device comprises a support bracket rigidly fixed to the tank and a stop cleat rigidly fixed to the upright member. Said support bracket and said cleat are provided respectively with a substantially horizontal plate, an elastic packing being disposed between said plates which are in oppositely-facing relation and assembled together by means of a bolt with vertical and radial play.

Preferably, the aforementioned elastic packing is pre-compressed, thus making it possible to maintain a simple contact at the time of relative vertical displacements between the cleats and the support brackets.

In a preferred embodiment, the tank is provided with an annular strengthening rib on each side of each cradle, the first coupling devices being placed between said cradle and the annular strengthening rib which is nearest to the corresponding end of the tank. Each second coupling device is placed between one upright member and that portion of the tank which is located between the corresponding annular strengthening ribs.

BRIEF DESCRIPTION OF THE DRAWINGS

A more complete understanding of the invention will be gained from the following description and from the accompanying drawings in which one embodiment of the invention is illustrated by way of example without any limitation being implied, and in which.

DETAILED DESCRIPTION

Figure 1:
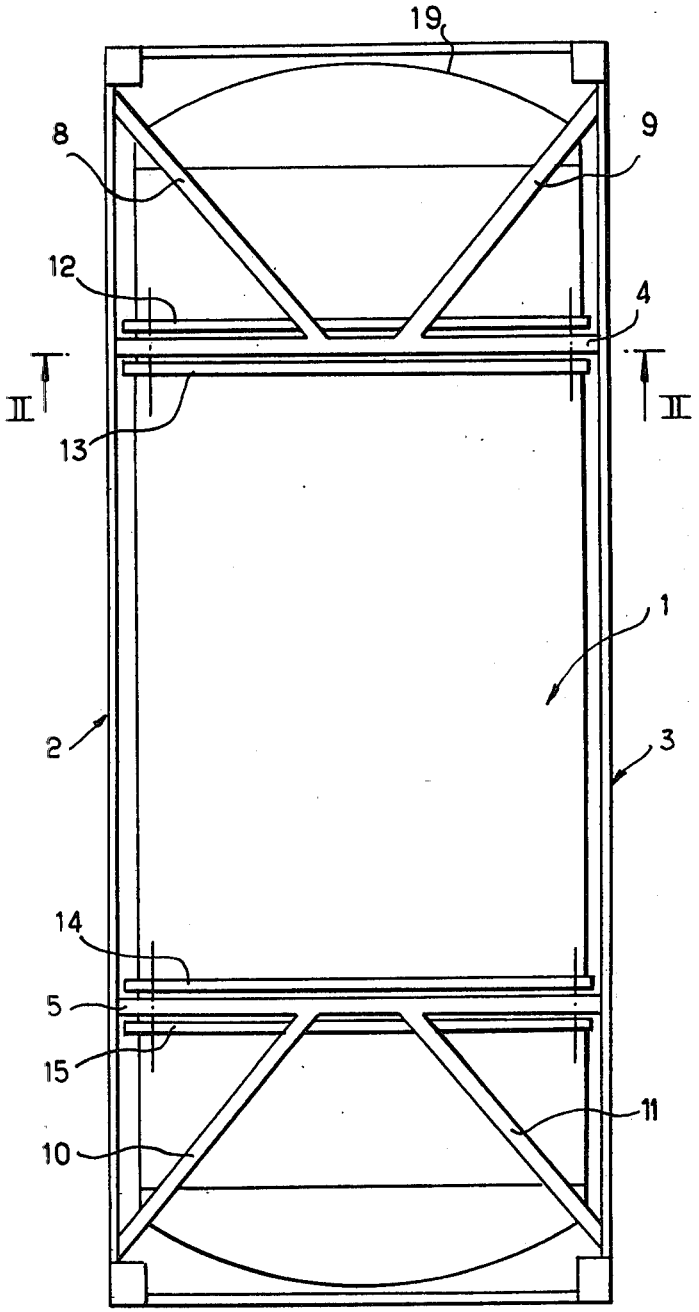
FIG. 1 is a bottom view of a container and of a tank in accordance with the invention.

The drawings illustrate a tank 1 and a container 2; the container 2 is composed of a substantially rectangular frame 3 and of two semi-circular cradles 4 and 5. Two diametrically opposite upright members 6 and 7 (shown in FIG. 2) are rigidly fixed to the cradle 4. Similar upright members (not shown in the figures) are also rigidly fixed to the cradle 5. The reference numerals 8, 9 and 10, 11 designate braces between the frame 3 and the cradles 4 and 5 respectively. The tank 1 has a pair of annular strengthening ribs 12, 13 placed on each side of the cradle 4, and a pair of annular strengthening ribs 14, 15 located on each side of the cradle 5. The tank 1 rests on the cradle 4 with interposition of a ring 16 and of an elastic member 17 of rubber or like elastomer, another ring 16 being added if necessary dependent on the thickness of the tank.

Figure 2:
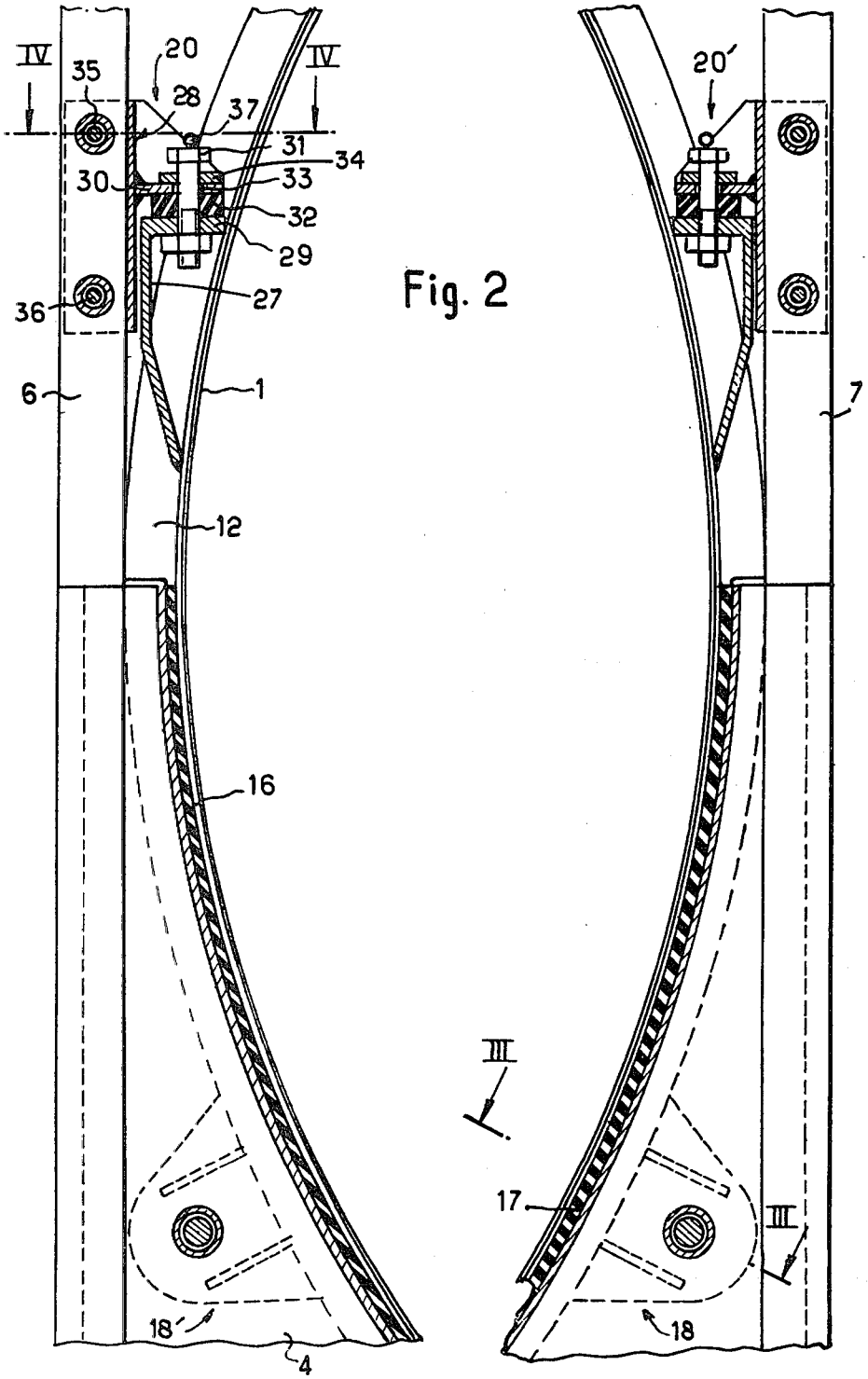
FIG. 2 is a partial view of a cross-section along line II—II of FIG. 1, but inverted to show the container in its position when in use with the bottom resting on a support surface.

The attachment system in accordance with the invention will be described with reference to the cradle 4 and to the annular strengthening ribs 12 and 13, it being understood that an identical system is employed for the cradle 5 and the annular ribs 14 and 15 and that the cradles are disposed in the lower part of the container for supporting the underside of the tank 1 as shown in FIG. 2.

The attachment system comprises a pair of first coupling devices 18, 18' between the cradle 4 and the annular strengthening rib 12, namely that annular rib of the pair 12, 13 which is nearest the corresponding end 19 of the tank 1, as well as a pair of second coupling devices 20, 20' between the tank 1 and respectively the upright member 6 and the upright member 7.

Figure 3:
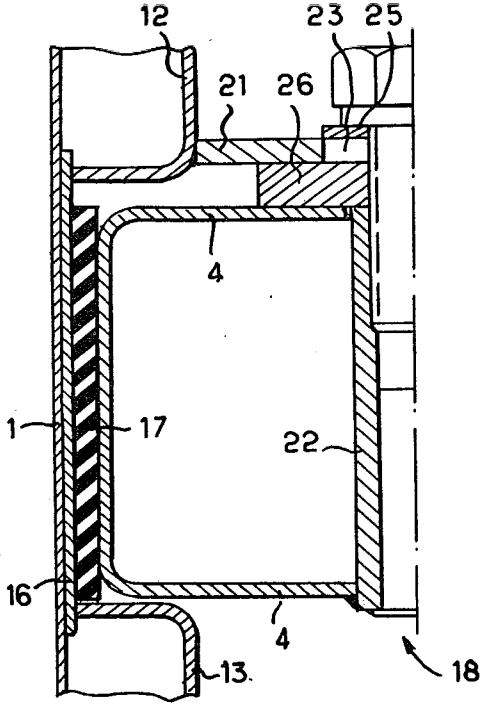
FIG. 3 is a cross-section taken along line III—III of FIG. 2.

The first coupling device 18 (shown in FIG. 3) comprises an arm 21 rigidly fixed to the annular strengthening rib 12 and oriented in the radial direction, and a threaded tube 22 oriented in the longitudinal direction within the cradle 4. The tube 22 is located opposite to an elongated slot 23 of the arm 21. A screw 24 is adapted to cooperate with the tube 22 and with a plate 25 which bears on the arm 21 whilst a packing-piece 26 is disposed between the arm 21 and a corresponding radial wall 4' of the cradle 4. After positioning of the tank 1 within the frame 3, the substantial clearance between the arm 21 and the cradle 4 is filled by the packing-piece 26, the thickness of which is chosen as a function of the clearance aforesaid. The elongated slot 23 has distinctly greater dimensions than the cross-section of the screw 24, thus permitting displacements in the vertical and transverse directions of the tank 1 whilst tightening of the screw 24 has the effect of stationarily fixing the tank in the longitudinal direction and producing a braking effect on the displacements mentioned above.

Figure 4:
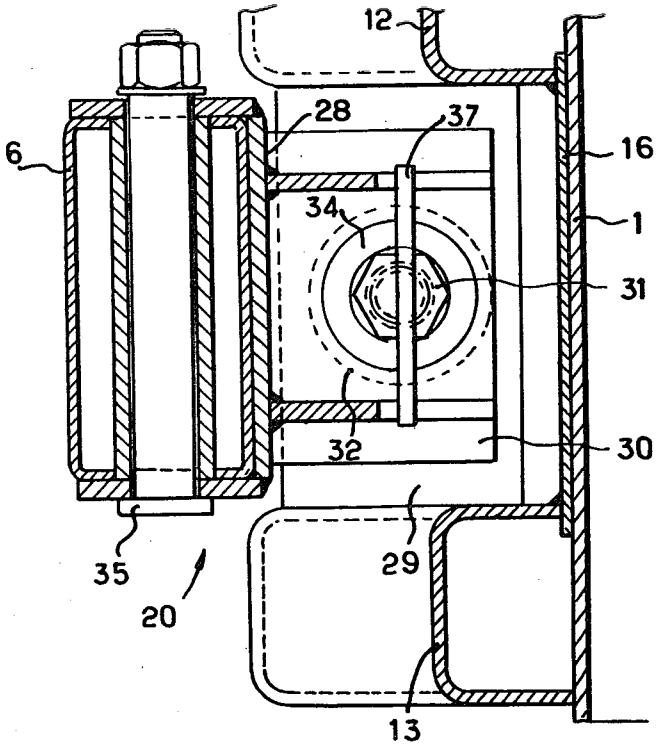
FIG. 4 is a cross-section taken along line IV—IV of FIG. 2.

The second coupling device 20 (shown in FIGS. 2 and 4) comprises a support bracket 27 which is welded to the tank 1, between the annular strengthening ribs 12 and 13 in oppositely-facing relation to the upright member 6, provision being also made for a stop cleat 28 which is bolted to the upright member 6. The support bracket 27 is constituted by a substantially horizontal plate 29 placed opposite to a substantially horizontal plate 30 of the cleat 28. Assembly is effected by means of a bolt 31, an elastic packing 32 being placed between the plates 29 and 30. The plate 30 of the cleat 28 is provided with an elongated slot 33 which permits radial play whilst a bearing washer 34 is interposed between the plate 30 and the bolt 31. After the tank 1 has been placed in position within the frame 3, the cleat 28 is secured to the upright member 6 by means of bolts 35 and 36. Positioning of the cleat 28 is carried out by compressing the elastic packing 32 by means of the bolt 31 which is then slackened-off but held in position by a cross-bar 37. The assembly is therefore effected with both vertical and radial play. The second coupling devices 20, 20' perform the function of damping devices for limiting the vertical and transverse displacements to those permitted by the first coupling devices 18, 18' and then ensure good resistance of the tank to overturning.

As will be readily apparent, the invention is not limited in any sense to the embodiment which has been described in the foregoing with reference to the accompanying drawings. Depending on the applications which are contemplated, the invention can accordingly be extended to many alternative embodiments within the capacity of anyone versed in the art without thereby departing either from the scope or the spirit of the invention.

What is claimed is:

1. A system for attachment of a cylindrical tank within a container frame comprising, at least two spaced cradles secured in the lower part of said frame transversely to the longitudinal axis of the tank, each cradle having a concave semi-circular support surface which substantially mates with the outer surface of said tank to support the tank, two vertical upright members for each cradle disposed diametrically oppositely with respect to each other, secured to each cradle and to said frame, each upright member having an inner face facing said tank, an elastic member inserted between said semi-circular support surface of each cradle and said tank, lower securing means for securing said tank to each cradle having connecting means which are rigid in the longitudinal direction and allow displacement in the vertical direction and directions transverse to the longitudinal axis of said tank, and upper retaining means for resiliently retaining said tank against vertical displacement, comprising a pair of upper coupling devices each disposed on opposite upper sides of said tank and comprising a bracket attached to said tank and having a planar substantially horizontal extending element, a cleat member attached to a respective upright member adjacent said bracket and having a planar element disposed in substantially parallel spaced relationship to said planar element of said bracket, an elastic member between said planar members, and connecting means for connecting said bracket and cleat members together with the elastic member effectively compressed to allow limited relative displacement of said bracket and cleat with respect to each other.

2. A system as claimed in claim 1, wherein said lower securing means comprises a pair of lower coupling devices each of which is disposed on opposite lower sides of said tank and comprises an arm secured to said tank and being transverse to the longitudinal axis thereof adjacent said cradle, an opening in said arm, bolt having a diameter smaller than said opening in said arm threadedly engaging with said cradle through said opening, and a washer located under the head of said bolt having an inner diameter which corresponds to the diameter of the bolt and an outer diameter larger than said opening in said arm.

3. A system as claimed in claim 1, wherein said connecting means of each of said upper coupling devices comprises a bolt which extends vertically through each said cleat and associated bracket, said cleat having a bolt-receiving opening in the planar element thereof larger than the diameter of said bolt, and a washer located under the head of said bolt having an inner diameter corresponding to the diameter of said bolt and an outer diameter larger than said opening.

* * * * *